US005237722A

United States Patent [19]

Ott

[11] Patent Number: 5,237,722

[45] Date of Patent: Aug. 24, 1993

[54] ROPE PULLING DEVICE

[76] Inventor: David L. Ott, 25538 Via Pacifica, Valencia, Calif. 91355

[21] Appl. No.: 865,847

[22] Filed: Apr. 9, 1992

[51] Int. Cl.[5] ..... A47B 95/02; A47J 45/10; E05B 1/00; E05B 7/00

[52] U.S. Cl. ..... 16/114 B; 16/122; 123/185.2

[58] Field of Search ..... 16/114 B, 122, DIG. 24; 123/185.2, 185.3

[56] References Cited

U.S. PATENT DOCUMENTS 3,083,366 3/1963 Franges ..... 294/171
3,375,813 4/1968 Hamman ..... 16/122
3,572,307 3/1971 Harkness et al. ..... 123/185.2

FOREIGN PATENT DOCUMENTS 255270 11/1986 Japan ..... 123/185.3

*Primary Examiner*—John Sipos
*Assistant Examiner*—Carmine Cuda
*Attorney, Agent, or Firm*—Jack C. Munro

[57] ABSTRACT

A device for use in hand pulling of rope wherein the rope includes a fixed enlarged section such as a knot. The device has an elongated, graspable, rod-like body which has a transverse slot located at the approximate longitudinal mid-point of the body. The rope is to be slipped into the slot with the knot abutting against the inside surface of the body.

3 Claims, 1 Drawing Sheet

ROPE PULLING DEVICE

BACKGROUND OF THE INVENTION

1) Filed of the Invention

The field of this invention relates to a device which is to be connectable to a rope which facilitates grasping of the rope to assist in rapid forceful pulling of the rope.

2) Description of the Prior Art

It is often necessary for humans to hold on to a rope and pull on it with a substantial amount of force in order to place a tensile loading on the rope. Sports such as sailing for example, utilize ropes in conjunction with the sails which are to be pulled in order to properly set the sail, raise the sail or like operations associated with the sail. Pulling directly on the rope by the hands of the human can cause injury to the hands. At the very least, the direct pulling of the rope by one's hands is not conducive to ease of operation.

In the past, numerous devices have been constructed to pull ropes. These devices vary from simple, hand-held items to more complicated devices such as winches and windlasses. The fact that such devices within the prior art are complicated has resulted in such devices not experiencing widespread usage resulting in the individual pulling directly on the rope itself.

The normal way for increasing tension in the hand pulling of a rope is to wrap the rope around the hand, pull the rope a short distance, unwrap the rope and move the hand forward on the rope, rewrap and repull and repeat until the required length of rope has been pulled. This wrapping and unwrapping slows down the rope pulling operation and can bruise the puller's hand.

SUMMARY OF THE INVENTION

The primary objective of the present invention is to construct a simple, hand-held rope puller that enables a person to pull a rope at a relatively high speed with substantially greater tension than would be possible with bare hands.

Another objective of the present invention is to provide a device for hand gripping a rope which facilitates engagement and disengagement from the rope.

Accordingly, the device of the present invention is to be used in manually exerting a tensile force on a rope which comprises an elongated handle adapted to fit in the palm of the user's hand. Formed within the handle is a transverse slot with this transverse slot located approximately at the longitudinal mid-point of the handle. The slot is to engage with the body of the rope and with there being a knot tied in the body of the rope. That knot is to abut against a bottom surface of the handle thereby fixing the rope to the handle. Where it is not feasible to have a knot present in the rope, the rope may be engaged in the slot of the grip and wrapped once (or twice) around the grip and the wrap held in place by compressing on the wrap with the hand of the user. One end of the slot is open to facilitate transverse entry and removal of the rope. The length of the slot is such that the longitudinal center axis of the rope would be located between the longitudinal center axis of the handle and the closed end of the slot so that the created torque of the tensile force would tend to keep the rope engaged with the handle.

Another objective of the present invention is to construct a rope pulling device which is light in weight and thereby can be used by individuals of minimal strength such as children.

Another objective of the present invention is to construct a rope pulling device which is of durable construction but yet relatively inexpensive thereby purchaseable by potential users at a relatively inexpensive price.

Another objective of the present invention is to construct a rope pulling device which can be used equally by individuals that are either both right and left handed.

Another advantage of the present invention is to construct a rope pulling device that can be used in conjunction with sailboats which permits trimming of the sail faster and with less effort.

Another objective of the present invention is to construct a rope pulling device that when utilized in conjunction with sailboats enhances the effectiveness of a crew member regardless of their age, size or physical ability.

Another object of the present invention is to utilize a rope pulling device in conjunction with sailboats which eliminates the commonly used manual rope wrapping arrangement which not only could cause the crew member's hands to be injured but could also cause the crew member's hands to become entangled and dragged from the deck of the boat into the water which could result in loss of life.

Another objective of the present invention is to construct a rope pulling device which can be quickly and easily installed and quickly and easily released in conjunction with the rope.

DETAILED DESCRIPTION OF THE SHOWN EMBODIMENT

Figure 1:
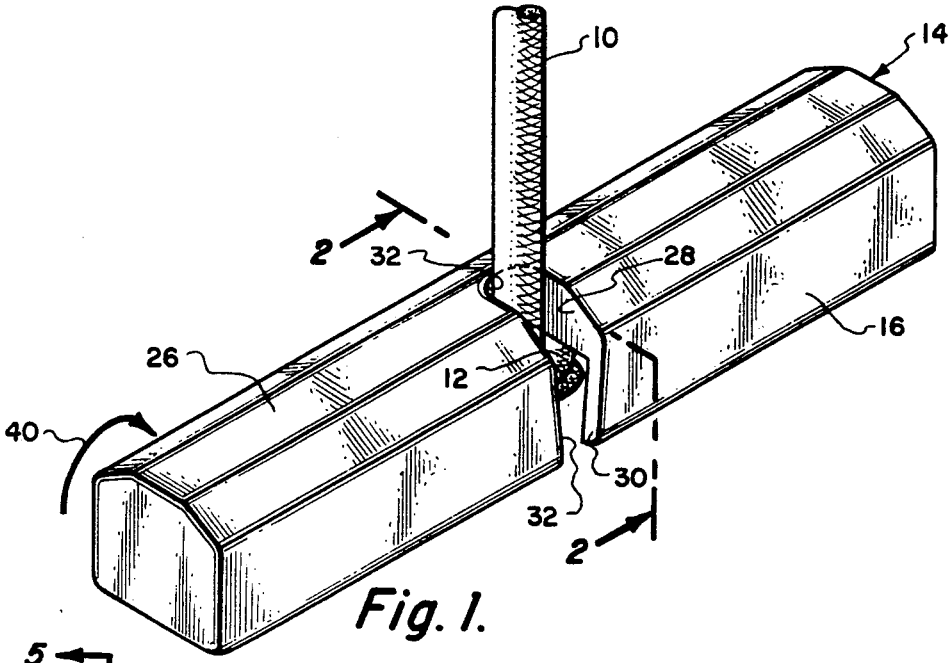
FIG. 1 is an isometric view of the rope pulling device of this invention showing the rope pulling device being utilized in conjunction with the rope.

Referring particularly to the drawing there is shown a rope 10 which is deemed to be conventional and terminates in a knot 12. It is to be understood that it is not necessary for the rope 10 to terminate at the knot 12 and actually there may be located a series of knots on the rope 10. However, in order to operate the rope pulling device of the present invention, there is required some form of a fixed enlargement on the body of the rope 10. A common form of such a fixed enlargement is a knot.

The rope pulling device 14 of this invention comprises an elongated body 16 which has a substantially hollow internal chamber 18. The body 16 will normally be constructed of a rigid moldable material such as plastic. The internal chamber 18 has an upstanding boss 20 located therein. The boss 20 terminates in a planar interior surface 22. Located on each side of the boss 20 in between the longitudinal end of the body 16 is a strengthening rib 24.

The exterior surface of the body 16 defines a convex top 26. The convex shape of the top 26 facilitates comfortable manual grasping of the rope pulling device 14 by a human.

Connecting with the boss 20 is a transverse slot 28. Slot 28 is located substantially at the mid-point of the longitudinal length of the body 16. The slot 28 has an open outer end defined between sidewalls 30 and 32. The sidewalls 30 and 32 are tapered so that they are closer together at the portion of the body 16 that is furthest from the convex top 26. The reason for this is to provide a certain amount of snugness for the body of the rope 10 as it is slipped between the sidewalls 30 and 32 which will have a tendency to maintain engagement with the rope 10 in order to deter accidental dislodgement of the rope 10 from the rope pulling device 14.

Figure 2:
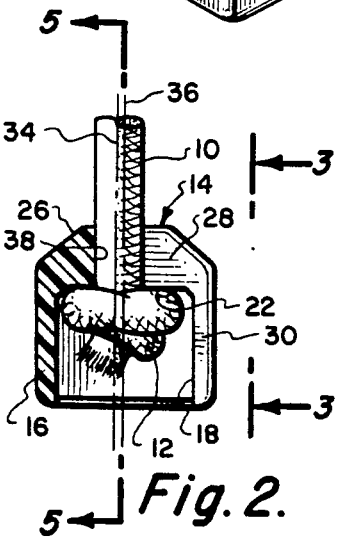
FIG. 2 is a cross-sectional view of the rope pulling device of the present invention taken along line 2—2 of FIG. 1.
Figure 3:
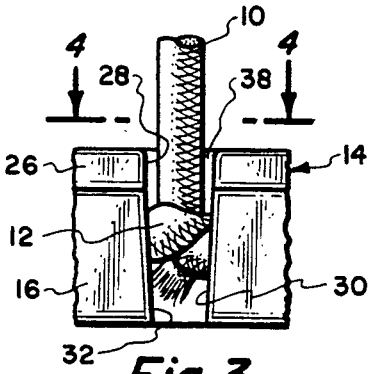
FIG. 3 is a front view of a portion of the rope pulling device of the present invention taken along line 3—3 of FIG. 2 showing in more detail the construction of the transverse slot within the body which the rope is to be located.
Figure 4:
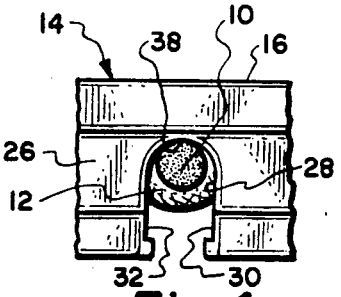
FIG. 4 is a top plan view of a portion of the rope pulling device of the present invention taken along line 4—4 of FIG. 3.
Figure 5:
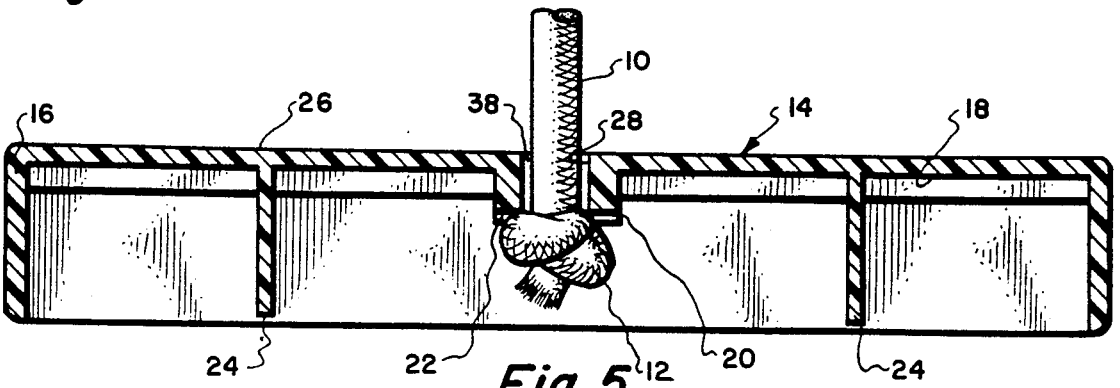
FIG. 5 is a longitudinal cross-sectional view of the rope pulling device of the present invention taken along line 5—5 of FIG. 2.

When the rope pulling device 14 is to be utilized, the longitudinal center axis 34 of the rope 10 is to be located between longitudinal center axis 36 of the body 16 and the closed end 38 of the slot 28. Therefore, the tensile force applied on the rope 10 will have a tendency to create a slight torque tending to rotate the body 16 clockwise (FIG. 2) as is represented by arrow 40 in FIG. 1. This slight torque will therefore tend to maintain the established connection between the rope 10 and the body 16 and will further tend to minimize the possibility of accidental dislodgement of the rope pulling device 14 when it is being used.

What is claimed is:

1. In combination with a rope, said rope having a longitudinal center axis, a rope pulling device to be used in conjunction with said rope, said rope pulling device comprising:

an elongated body having an exterior surface which is constructed to facilitate grasping by a human, said elongated body having a longitudinal center axis;

a slot formed in said elongated body transverse to both said center axes, said slot terminating in a pair of ends, one of said ends being open and the other said ends being closed, whereby said rope is to be locatable within said slot with a knot in said rope to abut against said elongated body preventing movement of said rope through said slot; and said rope longitudinal center axis is spaced from and located between the longitudinal center axis of said elongated body, and said closed end of said slot, said longitudinal center axis of said rope being perpendicularly oriented relative to said longitudinal center axis of said elongated body, as a pulling force is applied to said elongated body and said rope there is a slight twisting torque created tending to maintain engagement of said rope with said elongated body.

2. The combination as defined in claim 1 wherein:

said exterior surface of said elongated body being convex to thereby be comfortable to the human when grasping said elongated body, said transverse slot being located within said exterior surface.

3. The combination as defined in claim 2 wherein:

said transverse slot being located substantially at the mid-point of the longitudinal length of said elongated body.

* * * * *